US010086413B2

(12) United States Patent
Miyazaki et al.

(10) Patent No.: US 10,086,413 B2
(45) Date of Patent: Oct. 2, 2018

(54) POWDER DISCHARGE SYSTEM

(71) Applicant: EBARA CORPORATION, Tokyo (JP)

(72) Inventors: Kazutomo Miyazaki, Tokyo (JP); Hiroshi Ikeda, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 14/302,724

(22) Filed: Jun. 12, 2014

(65) Prior Publication Data

US 2014/0366958 A1 Dec. 18, 2014

(30) Foreign Application Priority Data

Jun. 17, 2013 (JP) ..... 2013-126400

(51) Int. Cl.

| | |
|---|---|
| ***B08B 9/093*** | (2006.01) |
| ***F23J 15/04*** | (2006.01) |
| ***F23J 15/06*** | (2006.01) |

(52) U.S. Cl.

CPC ..... *B08B 9/0933* (2013.01); *F23J 15/04* (2013.01); *F23J 15/06* (2013.01); *F23D 2900/00002* (2013.01); *F23J 2217/50* (2013.01); *F23J 2217/60* (2013.01); *F23J 2219/70* (2013.01); *F23J 2219/80* (2013.01); *Y10T 137/4259* (2015.04)

(58) Field of Classification Search

CPC ..... B08B 9/0933

See application file for complete search history.

(56) References Cited

U.S. PATENT DOCUMENTS

| | | | | |
|---|---|---|---|---|
| 3,788,243 | A * | 1/1974 | Eff | F23G 5/50 110/173 C |
| 4,900,524 | A | 2/1990 | Fullemann | |
| 2007/0186542 | A1 * | 8/2007 | Hirata | B01D 53/90 60/286 |
| 2009/0324747 | A1 | 12/2009 | Adams et al. | |
| 2010/0116140 | A1 | 5/2010 | Arai et al. | |

FOREIGN PATENT DOCUMENTS

| | | | |
|---|---|---|---|
| JP | S59-109232 | A | 6/1984 |
| JP | 4468920 | B2 | 3/2010 |
| WO | 0027762 | A1 | 5/2000 |

OTHER PUBLICATIONS

Extended European Search Report for Application No. 14172388.2 dated Nov. 6, 2014.

* cited by examiner

*Primary Examiner* — Donald R Spamer

(74) *Attorney, Agent, or Firm* — Pearne & Gordon LLP

(57) ABSTRACT

A powder discharge system is installed in a circulating water tank for collecting powder generated when an exhaust gas is treated in an exhaust gas treatment apparatus. The powder discharge system includes at least one eductor provided in the circulating water tank. The eductor has a nozzle configured to throttle a flow of water supplied from a pump for pumping water in the circulating water tank, a suction port configured to suck water in the circulating water tank into the eductor by utilizing a reduction of pressure generated when the flow of water is throttled by the nozzle, and a discharge port configured to eject the water sucked from the suction port together with the water discharged from the nozzle toward a bottom of the circulating water tank.

6 Claims, 5 Drawing Sheets

POWDER DISCHARGE SYSTEM

CROSS REFERENCE TO RELATED APPLICATION

This application claims priority to Japanese Patent Application No. 2013-126400 filed Jun. 17, 2013, the entire contents of which are hereby incorporated by reference.

BACKGROUND

In a semiconductor manufacturing process for manufacturing semiconductor devices, liquid crystal panels, LEDs or the like, a process gas is introduced into a process chamber which is being evacuated to perform various processes such as an etching process, a CVD process or the like. Further, the process chamber and exhaust apparatuses connected to the process chamber are cleaned periodically by supplying a cleaning gas thereto. Because exhaust gases such as the process gas, the cleaning gas or the like contain a silane-based gas, a halogen gas, a PFC gas or the like, such exhaust gases have negative effects on the human body and on the global environment such as global warming. Therefore, it is not preferable that these exhaust gases are emitted to the atmosphere as they are.

Accordingly, these exhaust gases are made harmless by the exhaust gas treatment apparatus provided at a downstream side of the vacuum pump, and the harmless exhaust gases are emitted to the atmosphere. In the exhaust gas treatment apparatus, in many cases, oxidation reaction treatment by combustion or application of heat from a heater is performed. In such combustion-type or heater-type exhaust gas treatment apparatus, when the exhaust gases containing silane ($SiH_4$) are treated through the oxidation reaction, silica ($SiO_2$) is produced. The produced silica is powdery, and adheres to an inner wall of a treatment chamber and becomes increasingly deposited. Therefore, it is necessary to remove periodically powdery product containing silica which has adhered to and has been deposited in the treatment chamber. Thus, a scraper is installed to scrape off the powdery product from the wall surface of the treatment chamber in the exhaust gas treatment apparatus. A circulating water tank is provided below the treatment chamber, and the powdery product scraped off by the scraper is deposited on the bottom of the circulating water tank.

Conventionally, in order to discharge powder deposited on the bottom of the circulating water tank, a bubbler is provided on the bottom of the circulating water tank and pressurized air is supplied to the bubbler, so that bubbling is performed in the circulating water tank to allow the powder to be floated and agitated, thereby automatically discharging the powder together with drainage water from the circulating water tank.

However, the bubbler tends to be clogged by the powder in structure at a nozzle portion for generating bubbles, and thus there is demand for a system which can discharge the powdery product accumulated on the bottom of the circulating water tank without using the bubbler.

Further, it is problematic that relatively small particles are floated and discharged by the bubbler, but large particles are not floated, thus being accumulated in the circulating water tank.

SUMMARY OF THE INVENTION

It is therefore an object to provide a powder discharge system which can increase a discharge rate of powder and can prolong a maintenance period of a circulating water tank by crushing and floating powdery product such as silica deposited in the circulating water tank for a scrubber installed at a downstream side in an exhaust gas treatment apparatus.

Embodiments, which will be described below, relate to a powder discharge system for use in a circulating water tank for a scrubber installed at a downstream side in an oxidation-reaction type exhaust gas apparatus such as a combustion-type or heater-type exhaust gas treatment apparatus for treating an exhaust gas discharged from a semiconductor manufacturing apparatus.

In order to achieve the above object, in an embodiment, there is provided a powder discharge system installed in a circulating water tank for collecting powder generated when an exhaust gas is treated in an exhaust gas treatment apparatus, the powder discharge system comprising: at least one eductor provided in the circulating water tank; the eductor comprising a nozzle configured to throttle a flow of water supplied from a pump for pumping water in the circulating water tank, a suction port configured to suck water in the circulating water tank into the eductor by utilizing a reduction of pressure generated when the flow of water is throttled by the nozzle, and a discharge port configured to eject the water sucked from the suction port together with the water discharged from the nozzle toward a bottom of the circulating water tank.

In an embodiment, the water ejected from the discharge port of the eductor crushes the powder deposited on the bottom of the circulating water tank and floats the powder, and the powder is discharged from the circulating water tank together with drainage water.

According to the embodiment, because the eductor is disposed at a suitable place in the circulating water tank in which the powder is accumulated, and water is ejected from the eductor to the bottom of the circulating water tank, the powder aggregated on the bottom of the circulating water tank is crushed and floated, and thus the powder can be efficiently discharged together with drainage water. Therefore, the discharge rate of the powder can be increased and a maintenance period of the circulating water tank can be prolonged.

In an embodiment, the eductor comprises a substantially cylindrical body part, and when an inner diameter of the body part is d1 (mm), an opening diameter d3 of the nozzle is set to d3=(0.16–0.26) d1 and a diameter d2 of the suction port is set to d2=(0.8–0.95)d1.

In an embodiment, water level of the circulating water tank is controlled to form a state where the water level is lower than the suction port of the eductor and a state where the water level is higher than the suction port of the eductor; when the water level is lower than the suction port of the eductor, only the water discharged from the nozzle is ejected from the eductor toward the bottom of the circulating water tank; and when the water level is higher than the suction port of the eductor, the water discharged from the nozzle and the water sucked from the suction port are ejected from the eductor toward the bottom of the circulating water tank.

According to the embodiment, in the state where water level of the circulating water tank is lower than the suction port of the eductor, i.e., the water level is low, the pump is operated to supply water to the eductor, and only the water discharged from the nozzle is ejected from the eductor toward the bottom of the circulating water tank to crush the aggregated powder on the bottom of the circulating water tank, thus making a diameter of powder smaller. Then, in the state where water level of the circulating water tank is higher than the suction port of the eductor, the water discharged from the nozzle and the water sucked from the suction port are ejected from the eductor toward the bottom of the circulating water tank. Therefore, the powder on the bottom of the circulating water tank is further crushed and water in the circulating water tank is agitated, and thus the powder accumulated on the bottom of the circulating water tank is floated, and is then automatically discharged together with drainage water from a drainage port.

In an embodiment, the powder generated when the exhaust gas is treated is collected in the circulating water tank through a connecting pipe, and the plural eductors are disposed around the connecting pipe.

According to the embodiment, since the plural eductors are disposed around the connecting pipe for introducing the powder into the circulating water tank, the powder accumulated at the position immediately below the connecting pipe can be crushed by the water ejected from the eductors and can be floated.

In an embodiment, the water ejected from the eductor is spreading conically and hits against the bottom surface of the circulating water tank at a circular ejected surface; and the circular ejected surface on the bottom surface of the circulating water tank is set so as to enter into a circle formed by vertically projecting a circle having a diameter equal to an inner diameter of the connecting pipe onto the bottom surface of the circulating water tank.

Since the powdery product generated by the exhaust gas treatment falls onto the bottom surface of the circulating water tank through the connecting pipe, the powdery product which has fallen tends to accumulate in the interior of the circle, immediately below the connecting pipe, having a diameter equal to an inner diameter of the connecting pipe. According to the embodiment, the water ejected from the eductor is spreading conically and hits against the bottom surface of the circulating water tank at a circular ejected surface. The circular ejected surface, on the bottom surface of the circulating water tank, onto which water ejected from the eductor is applied is set so as to enter into the circle formed by vertically projecting the circle having a diameter equal to the inner diameter of the connecting pipe onto the bottom surface of the circulating water tank. Therefore, the powdery product which has fallen onto the bottom surface of the circulating water tank through the connecting pipe and has been accumulated thereon can be crushed by an ejecting and hitting force of water ejected from the eductor, and thus can be floated.

In an embodiment, the circular ejected surfaces of the plural eductors are brought into contact with each other at their outer circumferences or have overlapping portions which overlap with each other.

According to the embodiment, since the circular ejected surfaces of the plural eductors are brought into contact with each other at their outer circumferences or have overlapping portions which overlap with each other, the interior of the circle, immediately below the connecting pipe, having a diameter equal to an inner diameter of the connecting pipe can be substantially covered by the ejected surfaces.

In an embodiment, there is provided an exhaust gas treatment apparatus comprising: a circulating water tank configured to collect powder generated when an exhaust gas is treated; a powder discharge system installed in the circulating water tank; the powder discharge system comprising: at least one eductor provided in the circulating water tank; the eductor comprising a nozzle configured to throttle a flow of water supplied from a pump for pumping water in the circulating water tank, a suction port configured to suck water in the circulating water tank into the eductor by utilizing a reduction of pressure generated when the flow of water is throttled by the nozzle, and a discharge port configured to eject the water sucked from the suction port together with the water discharged from the nozzle toward a bottom of the circulating water tank.

The above-described embodiments offer the following advantages.

(1) Because the eductor is disposed at a suitable place in the circulating water tank in which the powder is accumulated, and water is ejected from the eductor to the bottom of the circulating water tank while controlling water level of the circulating water tank, the powder aggregated on the bottom of the circulating water tank is crushed and floated, and thus the powder can be efficiently discharged together with drainage water. Therefore, the discharge rate of the powder can be increased and a maintenance period of the circulating water tank can be prolonged.

(2) By supplying compressed air to the eductor periodically (or as needed), the suction port of the eductor can be prevented from being clogged. Therefore, the eductor does not need maintenance at all.

BRIEF DESCRIPTION OF THE DRAWINGS

FIG. 3A is a perspective view of the eductor and FIG. 3B is a cross-sectional view of the eductor;

FIG. 5A is an elevational view and FIG. 5B is a plan view.

DETAILED DESCRIPTION OF EMBODIMENTS

Figure 1:
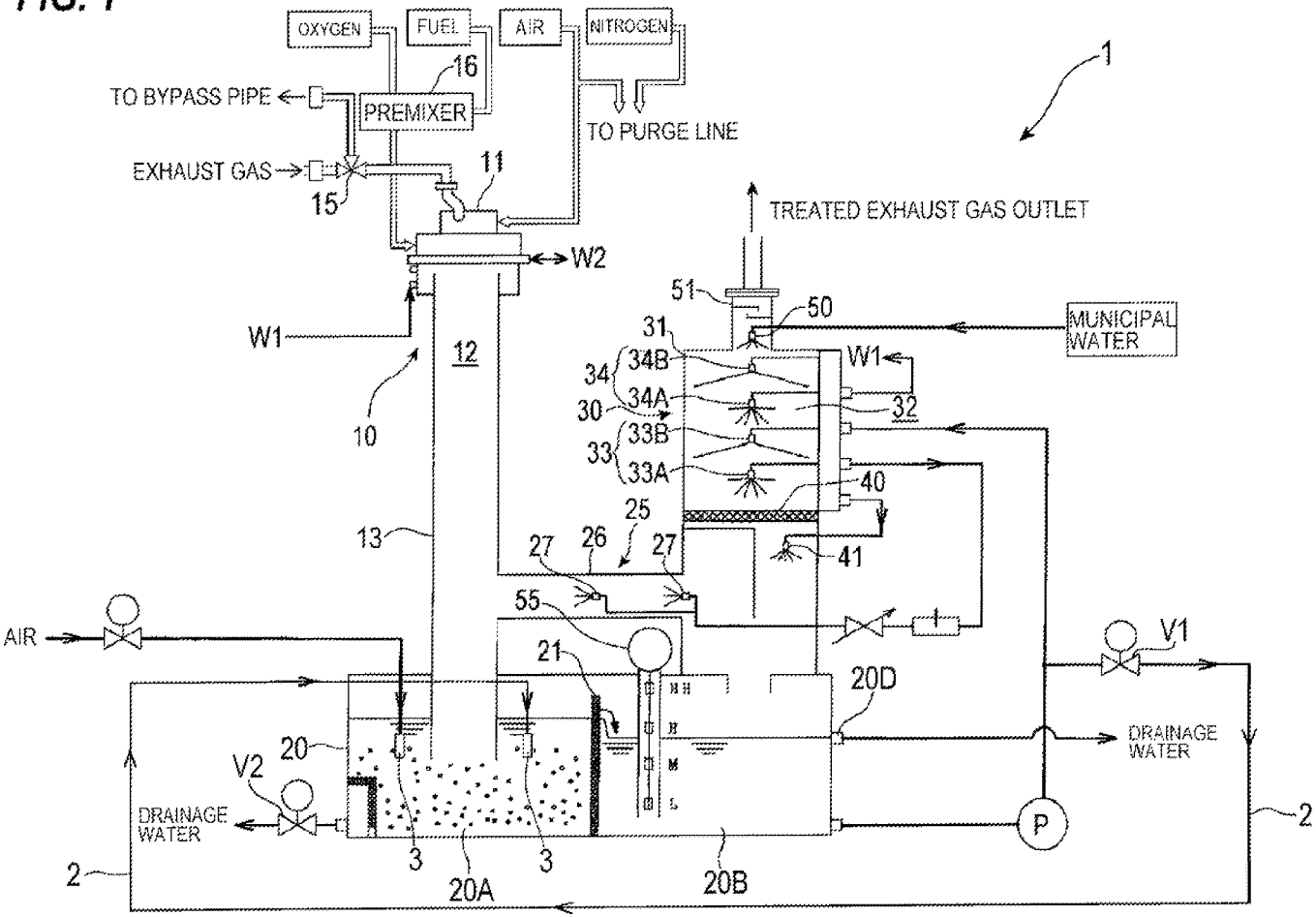
FIG. 1 is a schematic view showing an exhaust gas treatment apparatus having a powder discharge system according to an embodiment.

A powder discharge system according to embodiments will be described below with reference to FIGS. 1 through 5B. In FIGS. 1 through 5B, identical or corresponding parts are denoted by identical or corresponding reference numerals throughout views, and will not be described in duplication.

FIG. 1 is a schematic view showing an exhaust gas treatment apparatus 1 having a powder discharge system according to an embodiment. In FIG. 1, the exhaust gas treatment apparatus 1 comprises a combustion-type exhaust gas treatment apparatus by way of example. As shown in FIG. 1, the exhaust gas treatment apparatus 1 comprises a combustion-type heating treatment unit 10 for oxidatively decomposing an exhaust gas through combustion, and an exhaust gas cleaning unit 30 arranged at a stage subsequent to the heating treatment unit 10. The heating treatment unit 10 has a combustion chamber 12 for combusting the exhaust gas, and a burner 11 for generating flames swirling in the combustion chamber 12. The combustion chamber 12 extends downwardly by a combustion unit connecting pipe 13. The exhaust gas is supplied to the heating treatment unit 10 via a bypass valve (three-way valve) 15. If any problem is detected on the exhaust gas treatment apparatus, this bypass valve 15 is operated so that the exhaust gas is supplied to a bypass pipe (not shown) without being introduced into the exhaust gas treatment apparatus.

Fuel and oxygen are mixed in a premixer 16 in advance to form mixed fuel, and this mixed fuel is supplied to the burner 11. Further, air as an oxygen source for combusting (oxidizing) the exhaust gas is supplied to the burner 11. The burner 11 combusts the mixed fuel to form swirling flames in the combustion chamber 12, and the exhaust gas is combusted by the swirling flames. A UV sensor (not shown) is disposed inside the burner 11 and it is monitored by the UV sensor whether the swirling flames are formed normally. Air and nitrogen are supplied around the UV sensor as purge gas. Water W1 is supplied to the upper part of the combustion chamber 12. This water W1 flows down along the inner surface of the combustion chamber 12 and a water film is formed on the inner surface of the combustion chamber 12. The combustion chamber 12 is protected from heat of the swirling flames by the water film. Further, a cooling water passage (not shown) through which cooling water W2 for cooling the burner 11 flows is provided between the burner 11 and the combustion chamber 12.

The exhaust gas introduced into the combustion chamber 12 through the burner 11 is combusted by the swirling flames. Thus, combustible gases such as silane, disilane and the like contained in the exhaust gas is oxidatively decomposed. At this time, by combustion of the combustible gases, silica ($SiO_2$) is produced as powdery product. This silica exists in the exhaust gas as fine dust.

A part of such powdery product is accumulated on the burner 11 or the inner surface of the combustion chamber 12. Therefore, the heating treatment unit 10 is configured to operate a scraper (not shown) periodically so that the powdery product accumulated on the burner 11 or the inner surface of the combustion chamber 12 is scraped off. A circulating water tank 20 is disposed below the combustion chamber 12. A weir 21 is provided inside the circulating water tank 20, and the circulating water tank 20 is partitioned by the weir 21 into a first tank 20A at an upstream side and a second tank 20B at a downstream side. The powdery product scraped off by the scraper falls on the interior of the first tank 20A of the circulating water tank 20 through the combustion unit connecting pipe 13 and is accumulated on the bottom of the first tank 20A. Further, the water film which have flowed down along the inner surface of the combustion chamber 12 flows into the first tank 20A. Water in the first tank 20A flows over the weir 21 and flows into the second tank 20B.

The combustion chamber 12 communicates with an exhaust gas cleaning unit 30 through a cooling unit 25. This cooling unit 25 has a piping 26 extending toward the combustion unit connecting pipe 13 and a spray nozzle 27 arranged in the piping 26. The spray nozzle 27 sprays water countercurrently into the exhaust gas flowing in the piping 26. Therefore, the exhaust gas treated by the heating treatment unit 10 is cooled by water sprayed from the spray nozzle 27. The ejected water is recovered to the circulating water tank 20 through the piping 26.

The cooled exhaust gas is then introduced into the exhaust gas cleaning unit 30. This exhaust gas cleaning unit 30 is an apparatus for cleaning the exhaust gas with water and removing fine dust contained in the exhaust gas. This dust is mainly composed of powdery product produced by oxidative decomposition (combustion treatment) in the heating treatment unit 10.

The exhaust gas cleaning unit 30 comprises a wall member 31 for forming a gas passage 32, and a first mist nozzle 33A, a first water film nozzle 33B, a second mist nozzle 34A and a second water film nozzle 34B disposed in the gas passage 32. These mist nozzles 33A and 34A and water film nozzles 33B and 34B are located at the central portion of the gas passage 32, and are arranged substantially linearly. The first mist nozzle 33A and the first water film nozzle 33B constitute a first nozzle unit 33, and the second mist nozzle 34A and the second water film nozzle 34B constitute a second nozzle unit 34. Therefore, in this embodiment, two sets of nozzle units 33 and 34 are provided. One set of nozzle units or three or more sets of nozzle units may be provided.

The first mist nozzle 33A is disposed further upstream in a flowing direction of an exhaust gas than the first water film nozzle 33B. Similarly, the second mist nozzle 34A is disposed further upstream than the second water film nozzle 34B. Specifically, the mist nozzle and the water film nozzle are alternately disposed. The mist nozzles 33A and 34A, the water film nozzles 33B and 34A, and the wall member 31 are composed of corrosion-resistant resin (e.g., PVC: polyvinyl chloride).

A flow control member 40 for regulating flow of an exhaust gas is disposed at an upstream side of the first mist nozzle 33A. This flow control member 40 causes pressure loss of the exhaust gas and uniformizes the flow of the exhaust gas in the gas passage 32. It is preferable that the flow control member 40 is composed of a material other than metal in order to prevent acid corrosion. As an example of the flow control member 40, there is a nonwoven material made of resin or a resin plate having a plurality of openings. A mist nozzle 41 is disposed at an upstream side of the flow control member 40. The mist nozzles 33A, 34A and 41 and the water film nozzles 33B and 34B are attached to the wall member 31.

As shown in FIG. 1, the exhaust gas is introduced into the interior of the exhaust gas cleaning unit 30 from the piping 26 provided at a lower portion of the exhaust gas cleaning unit 30. The exhaust gas flows from the lower part to the upper part in the exhaust gas cleaning unit 30. More specifically, the exhaust gas introduced from the piping 26 is first directed toward the mist nozzle 41 of the exhaust gas cleaning unit 30. Then, the exhaust gas passes through the mist formed by the mist nozzle 41 and the flow of the exhaust gas is regulated by the flow control member 40. The exhaust gas which has passed through the flow control member 40 forms a uniform flow and moves upwards through the gas passage 32 at low speed. Mist, water film, mist and water film are formed in the gas passage 32 in that order.

Fine dust having a diameter of less than 1 μm contained in the exhaust gas easily adheres to water particles forming mist by diffusion action (Brownian movement), and thus the fine dust is trapped by the mist. Dust having a diameter of not less than 1 μm is mostly trapped by the water particles in the same manner. Since a diameter of the water particles is approximately 100 μm, the size (diameter) of the dust adhering to these water particles becomes large apparently. Therefore, the water particles containing dust easily hits the water film at the downstream side due to inertial impaction, and the dust is thus removed from the exhaust gas together with the water particles. Dust having a relatively large diameter which has not been trapped by the mist is also trapped by the water film in the same manner and is removed. In this manner, the exhaust gas is cleaned by water and the cleaned exhaust gas is discharged from the upper end of the wall member 31.

As shown in FIG. 1, the above-mentioned circulating water tank 20 is disposed below the exhaust gas cleaning unit 30. Water supplied from the mist nozzles 33A, 34A and 41 and the water film nozzles 33B and 34B is recovered into the second tank 20B of the circulating water tank 20. The water stored in the second tank 20B is supplied to the mist nozzles 33A, 34A and 41 and the water film nozzles 33B and 34B by a circulating water pump P. At the same time, the circulating water is supplied to an upper portion of the combustion chamber 12 of the heating treatment unit 10 as water W1, and as described above, the water film is formed on an inner surface of the combustion chamber 12.

Water to be supplied to the mist nozzles 33A and 34A and the water film nozzles 33B and 34B is water recovered by the circulating water tank 20 and contains dust (such as powdery product). Therefore, in order to clean the gas passage 32, municipal water is supplied to the gas passage 32 from a shower nozzle 50. A mist trap 51 is provided above the shower nozzle 50. This mist trap 51 has a plurality of baffle plates therein and serves to trap the mist. In this manner, the treated and detoxified exhaust gas is finally released into the atmosphere through the exhaust duct.

A water level sensor 55 is provided in the circulating water tank 20. The water level sensor 55 is configured to monitor water level of the second tank 20B and to control the water level of the second tank 20B within a predetermined range. Further, part of water delivered by the circulating water pump P is supplied to a plurality of eductors 3 installed in the circulating water tank 20 through a water supply pipe 2. The water supply pipe 2 has an opening and closing valve V1, and when the opening and closing valve V1 is opened, water can be supplied to the eductors 3. A drain valve V2 for discharging water in the circulating water tank 20 is provided on the circulating water tank 20.

Figure 2:
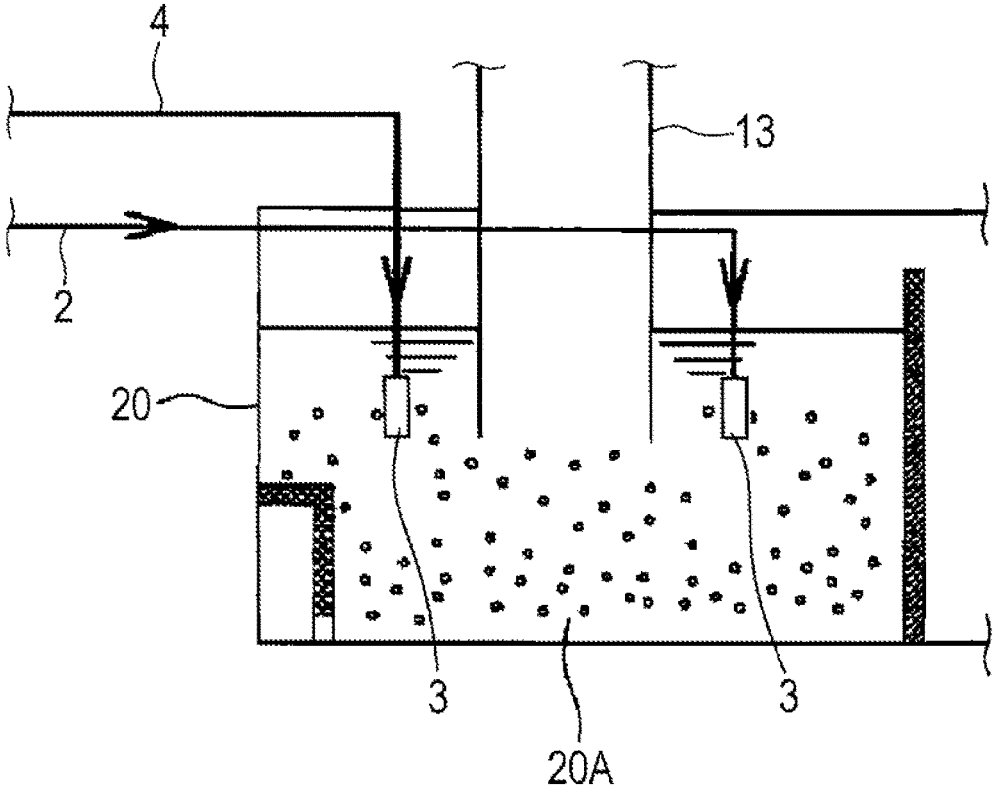
FIG. 2 is an enlarged view of a circulating water tank.

FIG. 2 is an enlarged view of the circulating water tank 20. In FIG. 2, the first tank 20A of the circulating water tank 20, the combustion unit connecting pipe 13 connected to the combustion chamber 12, and the plural eductors 3 installed in the first tank 20A are shown. As shown in FIG. 2, the plural (two in the illustrated example) eductors 3 are provided so as to surround the combustion unit connecting pipe 13 in the vicinity of the lower end of the combustion unit connecting pipe 13. The respective eductors 3 are connected to the water supply pipe 2, and water is supplied to the eductors 3 by the water supply pipe 2, and thus water can be ejected from the lower ends of the eductors 3 into the circulating water tank 20 (described later). Further, the respective eductors 3 are connected to an air supply pipe 4, and compressed air is supplied to the eductors 3, and thus suction ports of the eductors 3 can be prevented from being clogged (described later).

Figure 3A:
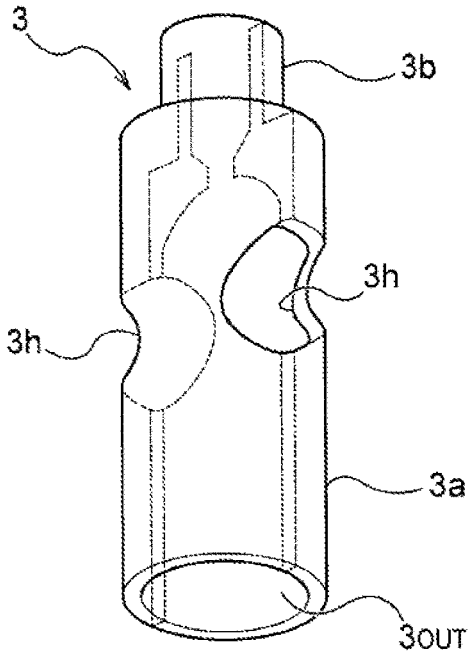
FIGS. 3A and 3B are views showing structural details of an eductor.
Figure 3B:
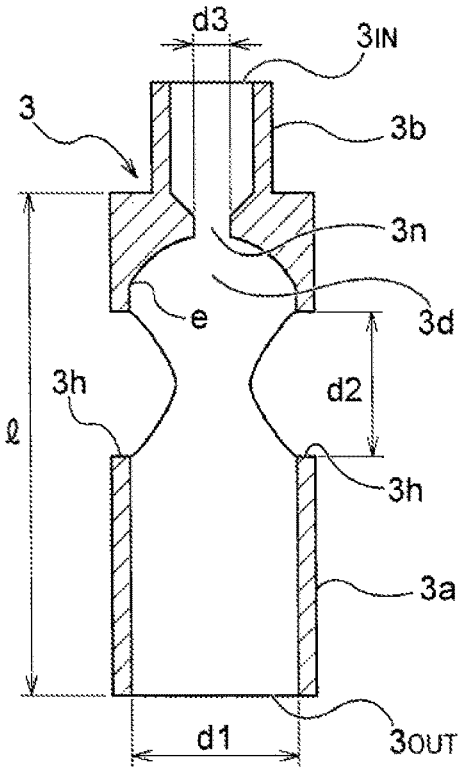

FIGS. 3A and 3B are views showing structural details of the eductor 3, and FIG. 3A is a perspective view of the eductor 3 and FIG. 3B is a cross-sectional view of the eductor 3. As shown in FIG. 3A and FIG. 3B, the eductor 3 comprises a substantially cylindrical body part 3*a*, and a water supply part 3*b* which is a cylindrical part having a smaller diameter than that of the body part 3*a*. The water supply part 3*b* is connected to the water supply pipe 2 so that water is supplied from the water supply pipe 2 to the water supply part 3*b*. As shown in FIG. 3B, the body part 3*a* has a nozzle 3*n* comprising a small diameter hole for ejecting water supplied from the water supply part 3*b* at a high speed, a diffusion chamber 3*d* whose opening area is gradually enlarged from the lower end of the nozzle 3*n* toward the cylindrical inner surface of the body part 3*a*, and two suction ports 3*h*, 3*h* positioned immediately below the diffusion chamber 3*d* and formed so as to face each other. The eductor 3 is disposed vertically in the circulating water tank 20 so that a water supply port $3_{IN}$ formed in the water supply part 3*b* is located at the upper part of the eductor 3 and a discharge port $3_{OUT}$ formed in the body part 3*a* is located at the lower part of the eductor 3.

Next, dimensional relationship of the respective parts of the eductor 3 will be described. As shown in FIG. 3B, when an inner diameter of the body part 3*a* is d1 (mm), an opening diameter d3 of the nozzle 3*n* is set to d3=(0.16–0.26)d1, and a diameter d2 of the suction port 3*h* is set to d2=(0.8–0.95) d1. Further, a length l of the body part 3*a* is set to l=(2.5–3.5)d1. The lower end "e" of the diffusion chamber 3*d* whose opening area is gradually enlarged from the lower end of the nozzle 3*n* toward the cylindrical inner surface of the body part 3*a* is set to the inner diameter d1. Specific dimensions of the eductor 3 used in the present embodiment are as follows: The inner diameter d1 is 19.6 mm, the diameter d2 of the suction port 3*h* is 17 mm, the opening diameter d3 of the nozzle 3*n* is 4.2 mm, the outer diameter of the body part 3*a* is 24 mm, and the length l of the body part 3*a* is 59 mm. The entire length of the eductor 3 including the body part 3*a* and the water supply part 3*b* is 72 mm, and the material of the eductor 3 is a resin material such as PVC. As shown in FIGS. 3A and 3B, the eductor 3 has a very simple structure and is a small, lightweight and inexpensive unit.

Figure 4A:
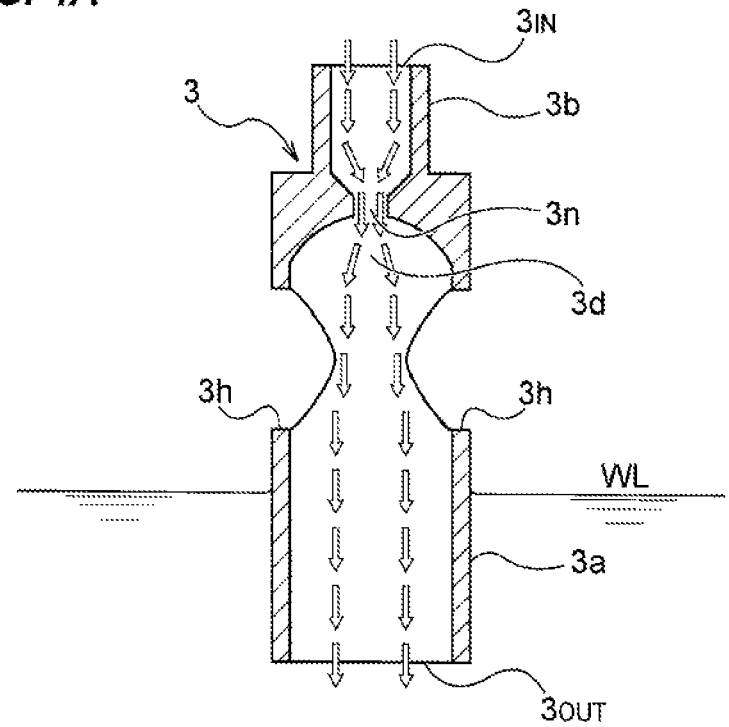
FIGS. 4A and 4B are schematic cross-sectional views showing an operation of the eductor in the case where the eductor shown in FIGS. 3A and 3B is installed in the circulating water tank.
Figure 4B:
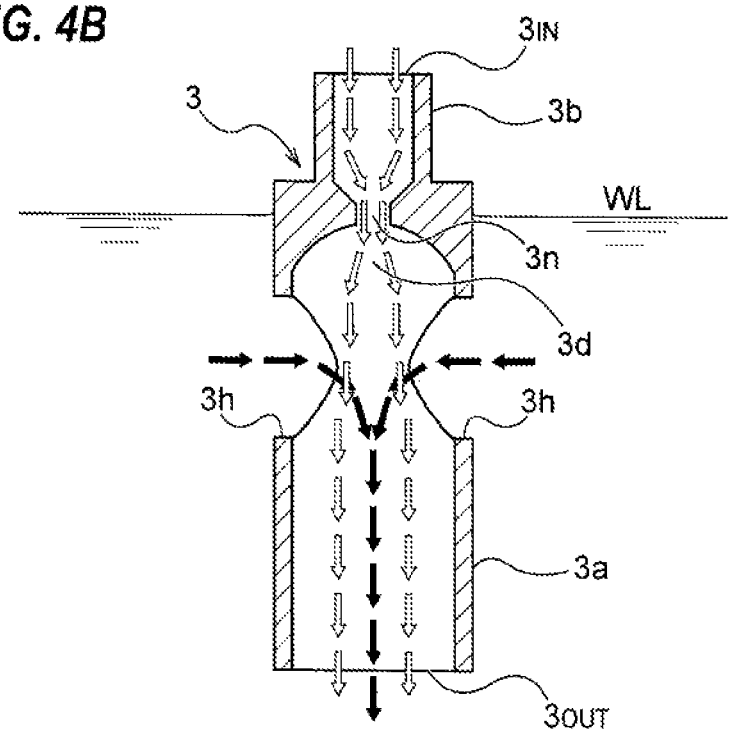

FIGS. 4A and 4B are schematic cross-sectional views showing an operation of the eductor 3 in the case where the eductor 3 shown in FIGS. 3A and 3B is installed in the circulating water tank 20.

FIG. 4A is a view showing the case where water level WL of the circulating water tank 20 is lower than the suction ports 3*h* of the eductor 3. As shown in FIG. 4A, water supplied from the water supply port $3_{IN}$ of the water supply part 3*b* is throttled by the nozzle 3*n* as shown by open arrows and is ejected to the diffusion chamber 3*d* at a high speed, and then water is discharged from the discharge port $3_{OUT}$ of the body part 3*a* while water is being expanded and diffused.

FIG. 4B is a view showing the case where water level WL of the circulating water tank 20 is higher than the suction ports 3*h* of the eductor 3. As shown in FIG. 4B, water supplied from the water supply port $3_{IN}$ of the water supply part 3*b* is throttled by the nozzle 3*n* as shown by open arrows and is ejected to the diffusion chamber 3*d* at a high speed. At this time, a pressure in the diffusion chamber 3*d* is lowered by the high-speed flow, and thus water in the circulating water tank 20 is sucked into the diffusion chamber 3*d* from the two suction ports 3*h*, 3*h* as shown by solid arrows. The water sucked from the suction ports 3*h*, 3*h* into the diffusion chamber 3*d* is discharged from the discharge port $3_{OUT}$ together with water which has flowed from the water supply port $3_{IN}$ of the water supply part 3*b*. In this case, when the amount of water supplied from the water supply port $3_{IN}$ of the water supply part 3*b* is Q, the amount of water sucked from the two suction ports 3*h*, 3*h* is about 4 Q, and thus water having a total amount of 5 Q is ejected from the eductor 3.

As shown in FIG. 4A, in the state where water level WL of the circulating water tank 20 is lower than the suction ports 3*h* of the eductor 3, i.e., the water level is low, the circulating water pump P is operated and the opening and closing valve V1 is opened to supply water to the eductor 3. Then, water is ejected at an amount Q from the eductor 3, and the ejected water of the amount Q crushes the aggregated powder on the bottom of the circulating water tank 20, thus making a diameter of powder smaller.

As shown in FIG. 4B, in the state where water level WL of the circulating water tank 20 is higher than the suction ports 3*h* of the eductor 3, water is ejected at an amount 5 Q from the eductor 3, and the ejected water of the amount 5 Q further crushes the aggregated powder on the bottom of the circulating water tank 20 and agitates water in the circulating water tank 20. Therefore, the powder accumulated on the bottom of the circulating water tank 20 is floated, and thus the powder is automatically discharged together with drainage water from a drainage port 20D (see FIG. 1). According to the embodiment, the water level WL of the circulating water tank 20 is controlled so as to form the state shown in FIG. 4A and the state shown in FIG. 4B.

Figure 5A:
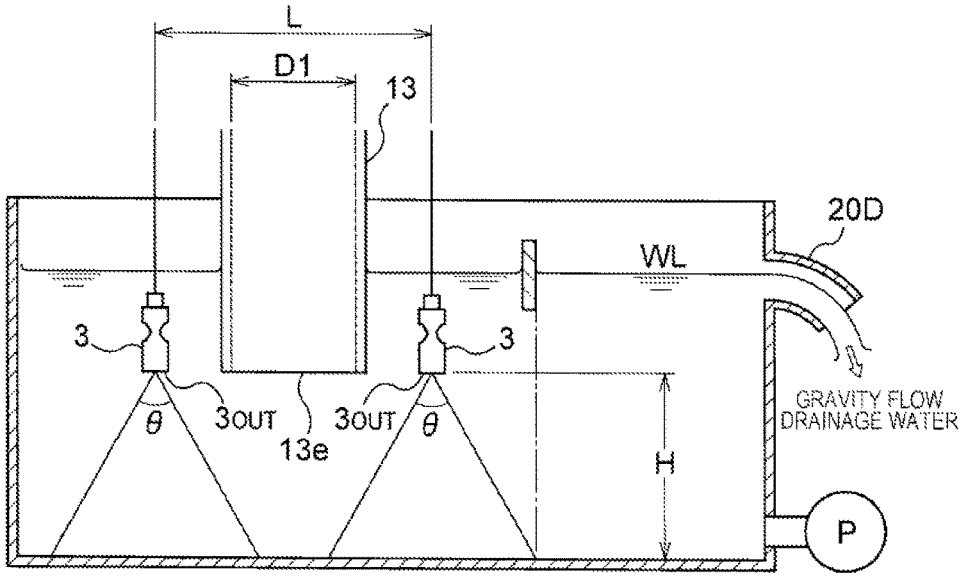
FIGS. 5A and 5B are schematic views showing the positional relationship between the combustion unit connecting pipe and the eductors.
Figure 5B:
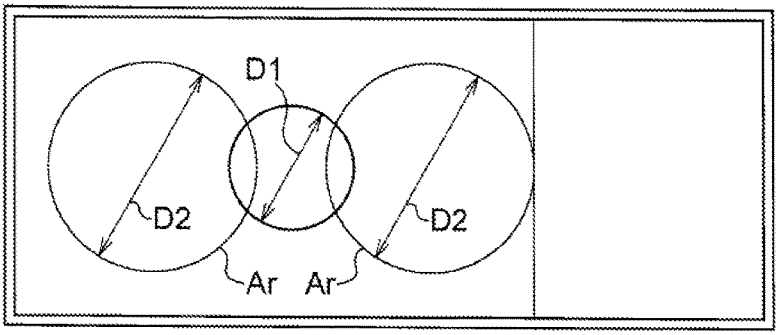

FIGS. 5A and 5B are schematic views showing the positional relationship between the combustion unit connecting pipe 13 and the eductors 3, and FIG. 5A is an elevational view and FIG. 5B is a plan view.

As shown in FIG. 5A, the height H of the discharge port $3_{OUT}$ of the eductor 3 substantially coincides with the position of the lower end 13*e* of the combustion unit connecting pipe 13. It is preferably that the height H of the discharge port $3_{OUT}$ of the eductor 3 is within the range of ±50 mm from a reference position of the lower end 13*e* of the combustion unit connecting pipe 13. The positions of the two eductors 3, 3 disposed radially outwardly of the combustion unit connecting pipe 13 are equally distant from the center of the combustion unit connecting pipe 13. When an inner diameter of the combustion unit connecting pipe 13 is D1, the distance L between centers of the two eductors 3, 3 is set to L=2D1–4D1. Specifically, the distance between the center of each eductor 3 and the center of the combustion unit connecting pipe 13 is set to (½)L, i.e. D1–2D1.

As shown in FIG. 5A, water ejected from each eductor 3 is spreading conically. A spray angle (θ) of the eductor 3 is set in the range of 30° to 70°. In the illustrated example, the spray angle (θ) is set to about 60°. As shown in FIG. 5B, water ejected from the eductor 3 hits against the bottom surface of the circulating water tank 20 at a circular ejected surface Ar having a diameter of D2. In the case where the spray angle (θ) of the eductor 3 is 60°, the diameter D2 of the circular ejected surface Ar is slightly larger than H, i.e., the diameter D2 becomes about 1.15 H ($2\ H/3^{1/2}$). As described above, the powdery product generated by the exhaust gas treatment falls onto the bottom surface of the circulating water tank 20 through the combustion unit connecting pipe 13. Therefore, the powdery product which has fallen tends to accumulate in the interior of the circle having a diameter of D1 immediately below the combustion unit connecting pipe 13.

Therefore, according to the embodiment, the circular ejected surface Ar, on the bottom surface of the circulating water tank 20, onto which water ejected from the eductor 3 is applied is set so as to enter into the circle having a diameter of D1 formed by vertically projecting the circle having a diameter equal to the inner diameter D1 of the combustion unit connecting pipe 13 onto the bottom surface of the circulating water tank 20. In this case, by setting the distance L between the centers of the two eductors in the range of 2D1 to 4D1 as described above, the range in the circle having a diameter of D1 into which the ejected surface Ar enters can be suitably enlarged. Therefore, if the two ejected surfaces Ar, Ar come close to each other at their outer circumferences or have overlapping portions which overlap with each other, the interior of the circle having a diameter of D1 can be substantially covered by the ejected surfaces Ar, Ar. By this setting, the powdery product which has fallen onto the bottom surface of the circulating water tank 20 through the combustion unit connecting pipe 13 and has been accumulated thereon can be crushed by an ejecting and hitting force of water ejected from the eductor 3.

Further, by controlling water level of the circulating water tank 20, when the water level of the circulating water tank 20 is low, water is ejected at an amount Q from each eductor 3 to enhance a crushing effect of the powdery product. When the water level of the circulating water tank 20 increases, water is ejected at an amount 5 Q from each eductor 3 to crush the powdery product further and to agitate water in the circulating water tank 20. Thus, the powder accumulated on the bottom of the circulating water tank 20 is floated, and then the powder is automatically discharged together with drainage water from the drainage port 20D.

In this manner, the discharge rate of the powder can be increased to 90% by the powder discharge system using the eductors 3 according to the embodiment, whereas the discharge rate of the powder is 70% in the conventional case using the bubbler.

Further, according to the embodiment, by supplying compressed air from the air supply pipe 4 to the eductor 3 periodically (or as needed), the powder existing in the suction port 3*h* of the eductor 3 can be discharged, and thus the eductor 3 can be prevented from being clogged with the powder. Therefore, blockade caused by the powder in the nozzle part which has occurred in the bubbler does not occur, and thus the rate-limiting of the maintenance period of the circulating water tank 20 is not determined by maintenance of the bubbler. Therefore, the maintenance period of the circulating water tank 20 can be prolonged more than double.

Although the combustion-type exhaust gas treatment apparatus is illustrated in FIG. 1, even in the heater-type exhaust gas treatment apparatus, the structure of the eductor 3 in the circulating water tank 20 is the same as that in FIGS. 2 through 5. In the present embodiment, an example where the two eductors 3 are disposed around the combustion unit connecting pipe 13 and face each other has been described, but three or more eductors 3 may be provided around the combustion unit connecting pipe 13 at equal intervals. In this case, it is desirable that the positions of three or more eductors 3 are set so that three or more circular ejected surfaces Ar of the eductors 3 come close to each other at their outer circumferences or have overlapping portions which overlap with each other.

Although the preferred embodiments of the present invention have been described above, it should be understood that the present invention is not limited to the above embodiments, but various changes and modifications may be made to the embodiments without departing from the scope of the appended claims.

What is claimed is:

1. An exhaust gas treatment apparatus comprising:

a heat treatment unit for oxidatively decomposing an exhaust gas containing silane-based gas, including at least one of silane ($SiH_4$) and disilane ($Si_2H_6$), discharged from a semiconductor manufacturing apparatus, the heat treatment unit comprising a combustion chamber for combusting the exhaust gas and a connecting pipe connected to the combustion chamber;

an exhaust gas cleaning unit arranged at a stage subsequent to the heat treatment unit for cleaning the exhaust gas discharged from the combustion chamber with water and removing fine dust contained in the exhaust gas, the exhaust gas cleaning unit being connected to the connecting pipe of the heat treatment unit; and a powder discharge system having a circulating water tank for collecting powder containing silica ($SiO_2$)

generated when the exhaust gas is combusted in the combustion chamber of the heat treatment unit and for supplying the water to the exhaust gas cleaning unit to clean the exhaust gas and recovering the water after cleaning the exhaust gas, the connecting pipe of the heat treatment unit extending downward into the circulating water tank and configured to lead the powder containing silica ($SiO_2$) into the circulating water tank, the powder containing silica ($SiO_2$) generated when the exhaust gas is combusted being accumulated on an inner surface of the combustion chamber and removed from the inner surface of the combustion chamber, and the removed powder containing silica ($SiO_2$) being collected in the circulating water tank through the connecting pipe and deposited on a bottom of the circulating water tank;

the powder discharge system comprising:

at least two eductors provided in the circulating water tank and disposed around the connecting pipe;

each eductor comprising a nozzle configured to throttle a flow of water supplied from a pump for pumping water in the circulating water tank, a suction port configured to suck water in the circulating water tank into the eductor by utilizing a reduction of pressure generated when the flow of water is throttled by the nozzle, and a discharge port configured to eject the water sucked from the suction port together with the water discharged from the nozzle toward the bottom of the circulating water tank;

wherein the discharge port of each eductor is positioned at the same vertical position as a position of a lower end of the connecting pipe; each eductor is disposed radially outward of the connecting pipe and equally distanced from a center of the connecting pipe at a distance between D1 and 2D1 wherein an inner diameter of the connecting pipe is D1 and a spray angle of each eductor is set in a range of 30° to 70°;

a drainage port provided at an upper part of the circulating water tank and configured to discharge water in the circulating water tank to the outside of the exhaust gas treatment apparatus; and a water level sensor configured to control a water level of the circulating water tank to form a state where the water level is lower than the suction port of each of the at least two eductors and a state where the water level is higher than the suction port of each of the at least two eductors;

when the water level is lower than the suction port of each of the at least two eductors, only the water discharged from the nozzle is ejected from each of the at least two eductors toward the bottom of the circulating water tank; and when the water level is higher than the suction port of each of the at least two eductors, the water discharged from the nozzle and the water sucked from the suction port are ejected from each of the at least two eductors toward the bottom of the circulating water tank;

wherein the water ejected from the discharge port of each of the at least two eductors crushes the powder containing silica ($SiO_2$) deposited on the bottom of the circulating water tank and floats the powder containing silica ($SiO_2$), and the powder containing silica ($SiO_2$) is discharged through the drainage port from the circulating water tank together with drainage water.

2. The exhaust gas treatment apparatus according to claim 1, wherein a circle projected on the bottom surface of the circulating water tank from the inner diameter of the connecting pipe is substantially covered by circular ejected surfaces created by the at least two eductors.

3. The exhaust gas treatment apparatus according to claim 1, further comprising:

a source of compressed air;

an air supply pipe fluidly connecting the source of compressed air to at least one of the two eductors; and a valve disposed in the air supply pipe for controlling the flow of compressed air to the at least one of the two eductors wherein the compressed air discharges the powder containing silica ($SiO_2$) disposed in the at least one of the two eductors.

4. The exhaust gas treatment apparatus according to claim 1, wherein each of the at least two eductors comprises a substantially cylindrical body part, and when an inner diameter of the body part is d1 (mm), an opening diameter d3 of the nozzle is set to d3=(0.16–0.26) d1 and a diameter d2 of the suction port is set to d2=(0.8–0.95) d1.

5. The exhaust gas treatment apparatus according to claim 1, wherein the at least two eductors and the connecting pipe are arranged in the circulating water tank so that the water ejected from each of the at least two eductors is spreading conically and hits against the bottom surface of the circulating water tank at a circular ejected surface; and the circular ejected surface on the bottom surface of the circulating water tank is set so as to enter into a circle formed by vertically projecting a circle having a diameter equal to an inner diameter of the connecting pipe onto the bottom surface of the circulating water tank.

6. The exhaust gas treatment apparatus according to claim 1, wherein the at least two eductors are arranged in the circulating water tank so that circular ejected surfaces of the at least two eductors are brought into contact with each other at their outer circumferences or have overlapping portions which overlap with each other.

* * * * *